US009950347B2

(12) United States Patent
Hegel et al.

(10) Patent No.: US 9,950,347 B2
(45) Date of Patent: Apr. 24, 2018

(54) INDIVIDUAL SORTING DEVICE FOR SORTING TABLETS, SYSTEM WITH SUCH AN INDIVIDUAL SORTING DEVICE AND WITH A TABLETING DEVICE, AND METHOD FOR CHECKING AN INDIVIDUAL SORTING DEVICE

(71) Applicant: KORSCH AG, Berlin (DE)

(72) Inventors: Walter Hegel, Berlin (DE); Arno Rathmann, Bernau (DE)

(73) Assignee: KORSCH AG, Berlin (DE)

( * ) Notice: Subject to any disclaimer, the term of this patent is extended or adjusted under 35 U.S.C. 154(b) by 0 days.

(21) Appl. No.: 14/769,460

(22) PCT Filed: Jan. 29, 2014

(86) PCT No.: PCT/EP2014/051727
§ 371 (c)(1),
(2) Date: Aug. 21, 2015

(87) PCT Pub. No.: WO2014/127965
PCT Pub. Date: Aug. 28, 2014

(65) Prior Publication Data

US 2015/0375268 A1 Dec. 31, 2015

(30) Foreign Application Priority Data

Feb. 22, 2013 (DE) ..... 10 2013 202 975

(51) Int. Cl.
*B07C 5/34* (2006.01)
*B30B 11/00* (2006.01)
(Continued)

(52) U.S. Cl.
CPC ..... *B07C 5/34* (2013.01); *B30B 11/005* (2013.01); *B30B 11/08* (2013.01); *B30B 15/32* (2013.01); *G07C 3/143* (2013.01)

(58) Field of Classification Search
CPC ..... B07C 5/00; B07C 5/02; B30B 11/005; B30B 11/08
(Continued)

(56) References Cited

U.S. PATENT DOCUMENTS 3,507,388 A 4/1970 Furtwaengler et al.
3,541,440 A * 11/1970 Silverman ..... G06F 11/2215 714/741
(Continued)

FOREIGN PATENT DOCUMENTS

DE 102005005012 A1 8/2006
DE 10 2009 020 196 A1 11/2010
(Continued)

OTHER PUBLICATIONS

JP Patent Application No. 2015-558387: Notification of Reasons for Refusal, Application number: Patent Application No. 2015-558387, Patent examiner: Toyoshima, Date of Drafting: Heisei 28(2016) Jun. 2017.

*Primary Examiner* — Terrell H Matthews
(74) *Attorney, Agent, or Firm* — Agris & Von Natzmer, LLP; Joyce Von Natzmer

(57) ABSTRACT

The invention relates to an individual sorting device (10) for sorting tablets which have been pressed by a tableting machine using press punches. The individual sorting device (10) comprises a tablet feed (20), a pressing force signal input (30) for receiving pressing force signals which can be assigned to the fed tablets, a programmable control unit (40), and a storage unit (50). The individual sorting device (10) is suitable for separating tablets to which an unacceptable pressing force signal can be assigned, said unacceptable pressing force signal lying outside of an accepted pressing force range, from tablets to which an acceptable pressing force signal can be assigned, said acceptable pressing force signal lying within the accepted pressing force range. A test
(Continued)

control program is stored in the storage unit (50) for programming the control unit (40) for a test operation of the individual sorting device (10), and during the test operation, the test control program includes the offset application of pressing force signals which can be assigned to tablets that have been pressed by at least one of the pressing punches of the tableting machine. The invention further relates to a system comprising a tableting device with multiple pressing punches and with an individual sorting device (10) and to a method for checking a proper functioning of an individual sorting device (10) for a tableting device with pressing punches.

17 Claims, 1 Drawing Sheet

(51) Int. Cl.
*B30B 11/08* (2006.01)
*B30B 15/32* (2006.01)
*G07C 3/14* (2006.01)

(58) Field of Classification Search
USPC ..... 209/552
See application file for complete search history.

(56) References Cited

U.S. PATENT DOCUMENTS 3,576,494 A * 4/1971 Bahls ..... G01R 31/25 324/408
4,030,868 A * 6/1977 Williams ..... B30B 11/005 264/109
4,123,352 A 10/1978 Yamamoto et al.
4,570,229 A 2/1986 Breen et al.
4,817,006 A * 3/1989 Lewis ..... B30B 11/005 264/40.5
5,229,044 A * 7/1993 Shimada ..... B30B 11/005 264/109
5,654,003 A * 8/1997 Fuisz ..... A61J 3/10 424/439
5,699,273 A * 12/1997 Hinzpeter ..... B30B 11/005 700/148
7,740,140 B2 * 6/2010 Schmidt ..... B30B 11/005 209/44.2
8,293,153 B2 10/2012 Isozumi
8,550,804 B2 * 10/2013 Mies ..... B30B 11/08 425/345
9,276,393 B2 * 3/2016 Ostrovsky ..... H02H 1/0015
2002/0004472 A1 * 1/2002 Holderbaum ..... C11D 17/0078 510/290
2017/0008066 A1 3/2017 Carstens et al.

FOREIGN PATENT DOCUMENTS

DE 102011050290 A1 11/2012
EP 2239133 A2 10/2010
JP 5665798 U 6/1981
JP 2002156333 A 5/2002
JP 2005311894 A 11/2005
JP 2006023018 A 1/2006
JP 2006256670 A 9/2006
JP 2011156576 A 8/2011
JP 2012110072 A 6/2012
WO 97/27044 A1 7/1997
WO 2012153283 A1 11/2012

* cited by examiner

INDIVIDUAL SORTING DEVICE FOR SORTING TABLETS, SYSTEM WITH SUCH AN INDIVIDUAL SORTING DEVICE AND WITH A TABLETING DEVICE, AND METHOD FOR CHECKING AN INDIVIDUAL SORTING DEVICE

CROSS-REFERENCE TO RELATED APPLICATIONS

This is the U.S. national stage of International application PCT/EP2014/051727, filed Jan. 29, 2014 designating the United States, claiming priority to German application DE10 2013 202 975.6, filed Feb. 22, 2013.

The invention relates to an individual sorting device for tablets. The invention furthermore relates to a system with such an individual sorting device and with a tableting device with a plurality of compression punches. Finally, the invention relates to a method for checking an orderly functioning of an individual sorting device for a tableting device with compression punches.

Tablets which on account of errors in the production process do not meet specific quality requirements can be discarded by way of an individual sorting device. Tablets may also be removed in a targeted manner from the production process by individual sorting for later examination.

Tablets may be produced using so-called tableting machines. Pharmaceutical rotary presses are one example of tableting machines.

A rotary press is known from DE 10 2009 020 196, for example. The rotary press has a rotor which is rotatably driven. The rotor rotates in a substantially horizontal plane. The rotor supports a multiplicity of pairs of punches. The pairs of punches are in each case composed of an upper punch and a lower punch. Raw material for tablets is filled at a predetermined point of the circumference of the rotor into the intermediate space between the upper punch and the lower punch. Once the pair of punches which has been filled in this way is moved by the rotation of the rotor in the circumferential direction of the latter, the two punches are moved together by control curves. The punches then make their way to at least one pressure roller unit. The pressure roller unit is downstream in the circumferential direction of the rotor. Using pressure, the punches in the pressure roller unit are pressed against one another. On account thereof, the material is compressed while forming the tablet. Subsequently, the punches enter a removal station which is downstream in the circumferential direction of the rotor. The punches diverge in the removal station, and the tablet is removed and discharged.

The location where the punches are pressed together using pressure is also referred to as a pressing station. A tableting machine may comprise one or a plurality of pressing stations. For example, the tablets may be precompressed in a first pressing station and the precompressed tablets may then be finally pressed in a second pressing station.

A plurality of individual pressing stations, or a plurality of groups of pressing stations for precompressing and final pressing may be arranged such that each pressing station compresses tablets independently from the other stations or groups, respectively, such that a plurality of tablets may be simultaneously produced.

The actual compressive force used in compressing a tablet provides information pertaining to the tablet weight and the reliability of compression. Moreover, it is desirable for reliably compressed tablets with weights which are as identical as possible to be produced. Individual sorting thus compares the actual compressive force with a permissible compressive-force range. Tablets which have been compressed with a compressive force which is outside the range are discarded by the individual sorting device. Here, each individual pressing station or group of pressing stations, respectively, is assigned one individual sorting device.

Discarding is performed by way of an air impulse or a slide, for example. Discarded tablets are routed into a first discharge duct. The other tablets are routed into a second discharge duct.

Usually, a compressive-force signal is infed to the individual sorting device for this purpose. The compressive-force signal emanates from a tableting machine and may be assigned to the tablet to be sorted.

In many applications it is very important to prove that individual sorting functions in an orderly manner. Testing the individual sorting device may be of interest when starting up the individual sorting device, whether in the context of the initial commissioning or in starting up for a new batch, or when starting a new product line or new stock, for example. According to the prior art, this is carried out as follows, for example:

A punch is removed and replaced by another punch. Here, using the replaced punch, tablets have been compressed with a compressive force which is outside the permissible compressive-force range. Moreover, the tablets have been compressed with an embossing which is characteristic of the replaced punch.

By means of the embossing the result of individual sorting may be readily checked for the correct functioning of the individual sorting.

However, since this method requires re-insertion of the normal punch after the test and thus opening of the tableting machine, this form of test operation cannot be considered for start-up testing of a normal operation which is subsequent thereto.

In order for the interventions in the system which are required after the test operation to be reduced, one of the present punches may also be modified only in terms of its impressed image by sticking on an embossing element. The embossing element may then be removed again after the test operation, without any major intervention in the tableting machine.

However, the modified punch normally does not lead to compressive-force signals outside the permissible compressive-force range. In order for individual sorting to be tested, the compressive-force range may be reduced such that the compressive-force signals are outside the reduced compressive-force range.

Alternatively, the modified compression punches are explicitly conveyed to the device.

The known methods for testing the correct functioning of individual sorting devices are either not integral, since they do not check the correct functioning of sorting by means of the compressive-force signal and the actually permissible compressive-force range, or are not suitable as a start-up test, since after the test operation and prior to the normal operation they require major interventions in the system.

Therefore, according to the invention an individual sorting device for sorting tablets according to claim 1 is proposed. The tablets here have been compressed by a tableting machine using compression punches. The individual sorting device is suitable for separating tablets which can be assigned an impermissible compressive-force signal from tablets which can be assigned a permissible lying compressive-force signal. Impermissible compressive-force signals are outside a permissible compressive-force range. Permissible compressive-force signals are within the permissible compressive-force range.

The individual sorting device comprises a tablet infeed, a compressive-force signal input for receiving compressive-force signals which are assignable to the infed tablets, a programmable controller unit, and a memory. The individual sorting device is characterized in that a test control program is stored in the memory. The test control program is provided for programming/parametering the controller unit for a test operation. The test operation comprises impinging, with an offset, compressive-force signals of at least one of the compression punches.

Impinging individual compressive-force signals with an offset enables that the individual sorting device identifies the tablets by means of the compressive-force signals, since impinging leads to a compressive-force signal outside the permissible range.

Furthermore, according to the invention a system with a tableting device with a plurality of compression punches and at least one individual sorting device according to the invention is proposed.

In one embodiment of the individual sorting device, or of the system, respectively, the test operation comprises storing of signals which are received and generated during the test operation. A report is compiled at the end of the test operation, using the stored signals.

The test control program here may be part of a normal operation program. The test operation may precede a normal operation. That is to say that a normal operation program for a normal operation may also be stored in the memory of the individual sorting device.

The individual sorting device may deliver the mutually separated tablets at two tablet deliveries and comprise at least one detection device. The detection device may be disposed on one of the tablet deliveries. The detection device may be suited to detecting tablets delivered there. The detection device here is connected to the controller unit, and the controller unit is configured for counting a number of detected tablets.

The execution of the normal operation program for the normal operation may be suppressed if a number of the tablets detected during the test operation do not correspond to a nominal number.

The nominal number may be determined by a number of the compression punches of the tableting machine, a number of the compression punches which are impinged with the offset compressive-force signal, and a total number of tablets sorted during the test operation.

Furthermore, according to the invention a method for checking the orderly functioning of an individual sorting device for a tableting device with compression punches is proposed. The method here comprises producing the tablets, using the tableting device, and infeeding the tablets and compressive-force signals which are assignable to the tablets to the individual sorting device. By comparing the compressive-force signals with a permissible compressive-force range, the assigned tablets are classified as permissible or impermissible. Classifying is performed depending on the result of the comparison. Impermissible tablets are discarded. Here, prior to comparing, the compressive-force signals of at least one selected pressing station are impinged with an offset. Not all compression punches are selected here. An absolute value of the offset(s) is selected such that the impinged compressive-force signals are outside the permissible compressive-force range.

In one advantageous embodiment of the method, additionally a number of tablets produced by the selected compression punches and a number of discarded tablets are determined. Then, the determined numbers are compared. Then, for example, the execution of a normal operation which is subsequent to the check may be rendered dependent on whether the determined numbers are equal.

In this or another advantageous embodiment of the method, the selected compression punches may be manipulated such that the tablets produced by means of the modified compression punches have an impressed image which is differentiable from an impressed image of the remaining produced tablets. The method then may furthermore comprise inspecting the impressed image of the discarded tablets.

An absolute value of the offset may be equal to or greater than half a compressive-force differential between an upper limit of the compressive force of the permissible compressive-force range and a lower limit of the compressive force of the permissible compressive-force range. In particular, the absolute value of the offset may be equal to or greater than the compressive-force differential.

Exemplary embodiments of the invention will be explained in more detail by means of the drawings and the following description. In the drawings.

Figure 1:
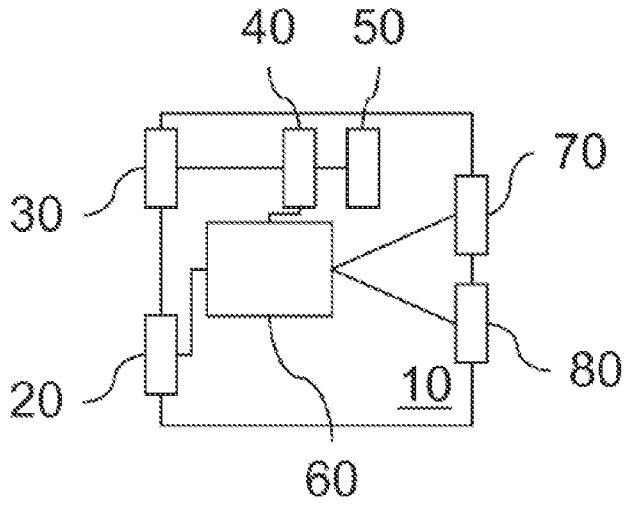
FIG. 1 shows a first exemplary embodiment of the invention.

FIG. 1 shows a first embodiment of an individual sorting device according to the invention. The individual sorting device serves for sorting tablets which have been compressed by a tableting machine using compression punches. The tableting machine here may comprise one or a plurality of independent pressing stations or groups of pressing stations which are arranged such that each pressing station compresses tablets independently from the other stations or groups, respectively, such that a plurality of tablets may be simultaneously produced. Advantageously, there is one individual sorting device for each independent pressing station or group of pressing stations, respectively.

The individual sorting device 10 comprises a tablet infeed 20, a compressive-force signal input 30 for receiving compressive-force signals which are assignable to the infed tablets, a controller unit 40, and a memory 50. The controller unit 40 is a computer, a controller, or a programmable controller unit, for example.

Tablets are infed to the individual sorting device 10 via the tablet infeed 20, and compressive-force signals which are assigned to the tablets are infed via the signal input 30.

Various programs which are stored in the memory 50 may be uploaded to the controller unit 40. Sorting based on the uploaded program is then executed in that the controller unit 40 actuates a sorting unit 60. The sorting unit 60 then sorts the tablets in a manner corresponding to the actuation and delivers said tablets at one of at least two tablet deliveries 70, 80 which are present, for example into collection containers or onto conveying devices (both not illustrated).

In this exemplary embodiment, at least two programs are stored in the memory 50. One of the programs serves for a normal operation, and one for a test operation. In both operational modes the compressive-force signals and a predefined like compressive-force range are used by the controller unit 40 for determining the respective actuation of the sorting unit 60.

However, while in the normal operation the compressive-force signals which are actually received at the compressive-force signal input 30 are compared with the compressive-force range and tablets having compressive-force signals which are outside the compressive-force range are separated from tablets having compressive-force signals which are within the compressive-force range, in the test operation compressive-force signals of selected compression punches are impinged by the controller unit 40 with an offset and only then compared with the compressive-force range. The selected compression punches may hereby be impinged with different offsets. The offset may be a positive one. In this case, in particular, correct sorting in the event of an upper limit of the compressive force of the permissible compressive-force range being exceeded may be verified. The offset may also be a negative one. In this case, in particular, correct sorting in the event of a lower limit of the compressive force of the permissible compressive-force range being undershot may be verified.

In one exemplary embodiment, the absolute value of the offset is equal to or greater than a compressive-force differential between the upper limit of the compressive force and the lower limit of the compressive force. In this case, the total signal (the compressive-force signal impinged so as to be offset) definitely is outside the range.

In one other exemplary embodiment, the value of the offset is equal to or greater than half the compressive-force differential. Compressive-force signals actually substantially correspond to the mean value of the upper limit of the compressive force and the lower limit of the compressive force. The modest offset thus leads to a total signal which is above the upper limit of the compressive force. At the same time, the total signal is not large enough for a maximum compressive force to be exceeded. The maximum compressive force here is a limit of the compressive force which leads to an interruption of the process, for example in order to protect tooling, the machine, or humans.

In yet another exemplary embodiment, the value of the offset is determined so as to be individual for each pressing station. For example, the value of the offset may depend on a previously established mean value of compressive-force signals of the respective pressing station and one of the two limits of the compressive force.

The compressive-force signals of the selected stations are thus modified such that they represent a compressive force which is outside the permissible compressive-force range.

After a run comprising a certain number of tablets, it may be determined by means of the ratio of the number of selected compression punches to the total number of compression punches how many tablets would have to be discarded as being impermissible if post-sorting would always function in a correct manner.

Additionally, in the tableting machine which compresses the tablets, the punches in the selected compression punches in terms of their impressed image may be modified such that tablets compressed by the selected compression punches are differentiable from the tablets compressed by other compression punches. This may be made possible by sticking on a structured film, a piece of adhesive crepe tape, or a piece of adhesive transparent tape.

In this case, it is additionally possible to check whether only those tablets which have been compressed by the selected compression punches have always been discarded.

Since the modification of the punch leads to a modification of the compressive force, it is advantageous for the offset to be determined individually.

Figure 2:
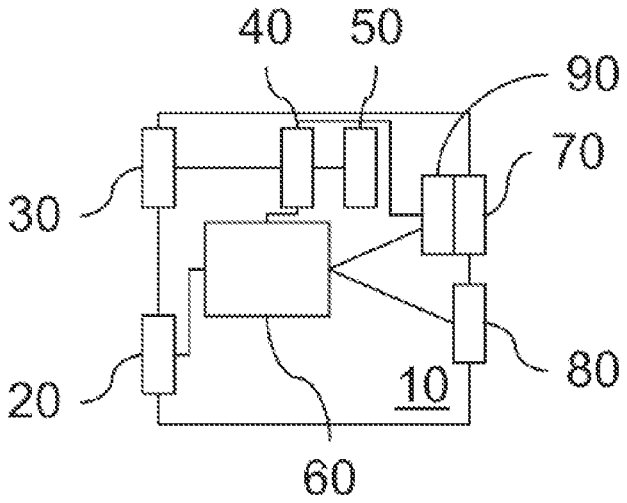
FIG. 2 shows a second exemplary embodiment of the invention.

In order for this check to be automated, the individual sorting device 10 of the second exemplary embodiment additionally comprises a detection device 90. The detection device 90 may be a vision system, for example, such as a light barrier, a light sensor, or a camera system. This is illustrated in an exemplary manner in FIG. 2. The detection device 90 is disposed on one of the two tablet deliveries 70, 80. The detection device 90 detects whether a tablet has been delivered. Delivery of a tablet is signaled to the controller unit 40. The controller unit 40 counts the signals of the detection device 90 and determines the total number of tablets which have been delivered at the tablet delivery. As the test program commences, the counter here is set to zero.

The controller unit 40 in this exemplary embodiment integrates or counts, respectively, also the number of received compressive-force signals. The controller unit 40 in this way determines the number of infed tablets. Alternatively or additionally, a further detection device (not illustrated), with the aid of which the controller unit 40 can determine the number of infed tablets, may be disposed on the tablet infeed 20. As the test program commences, the counter for the number of infed tablets here is also set to zero.

In this case, after infeeding a predetermined number of tablets, for example 1000 or 2000 units, it is possible to automatically check whether the proportion of infed tablets which corresponds to the ratio of the number of selected compression punches to the total number of compression punches has actually be discarded.

In as far as the controller unit 40 establishes that there is no discrepancy between the number of tablets to be discarded and the number of actually discarded tablets, a normal operation may immediately succeed the test operation in which the predetermined number of tablets has been infed.

However, if by contrast the controller unit 40 establishes a discrepancy between the number of tablets to be discarded and the number of actually discarded tablets, the normal operation may be prevented.

It is also possible for the controller unit 40 in relation to each impingement with an offset to check whether a detection signal is correspondingly received from a detection device in the tablet delivery for impermissible tablets, or whether a detection signal is not corresponding received from a detection device in the tablet delivery for permissible tablets. Then, if an expected detection signal is not received, or an unexpected detection signal is received, respectively, the controller unit 40 may also check whether the correct tablets have been discarded.

Alternatively or additionally, in the tableting machine which compresses the tablets the selected compression punches in terms of their impressed image may be modified such that tablets compressed by the selected compression punches may be automatically differentiable from tablets compressed by other compression punches by means of an image recognition device. This may be made possible by sticking on a structured film, a piece of adhesive crepe tape, or a piece of adhesive transparent tape.

The image recognition system may then be disposed on one of the two tablet deliveries 70, 80. The imager recognition device may acquire the impressed image and automatically detect whether the acquired impressed image corresponds to an impressed image which the tablets delivered at this tablet delivery should have.

LIST OF REFERENCE SIGNS

10 Individual sorting device
20 Tablet infeed
30 Compressive-force signal input

40 Controller unit
50 Memory
60 Sorting unit
70 Tablet delivery
80 Tablet delivery
90 Detection device

The invention claimed is:

1. An individual sorting device for sorting tablets which have been compressed by a tableting machine using compression punches, the individual sorting device comprising:

a removably attached embossing element configured (i) to be removably attached to at least one of the compression punches during a test operation and (ii) to provide an impressed image, a tablet infeed, a compressive-force signal input for receiving compressive-force signals which are assignable to the infed tablets, a programmable controller unit, a memory, and a sorting unit, wherein the individual sorting device through the sorting unit is configured to separate (a) tablets, to which an impermissible compressive-force signal which is outside a permissible compressive-force range has been assigned, from (b) tablets, to which a compressive-force signal which is within the permissible compressive-force range has been assigned, wherein the memory stores a test control program configured to program the programmable controller unit for the test operation of the individual sorting device, wherein the test control program is also configured, during the test operation, to impinge, incorporating an offset, compressive-force signals which can be assigned to the tablets which have been compressed by at least one of the compression punches of the tableting machine.

2. The individual sorting device as claimed in claim 1, wherein the test operation comprises storing of signals which are received and generated during the test operation and compiling a report at the end of the test operation, using the stored signals.

3. The individual sorting device as claimed in claim 1, wherein the test control program is part of a normal operation program and the test operation precedes a normal operation.

4. The individual sorting device as claimed in claim 1, further comprising two tablet deliveries and at least one detection device which is disposed on one of the tablet deliveries and is configured to detect tablets delivered thereby, wherein the detection device is connected to the controller unit and the controller unit is configured for counting a number of detected tablets.

5. The individual sorting device as claimed in claim 3, wherein the normal operation program suppresses the normal operation if a number of tablets counted during the test operation does not correspond to a nominal number.

6. The individual sorting device as claimed in claim 5, wherein the nominal number is determined by a number of the compression punches of the tableting machine, a number of the compression punches which are impinged with the offset compressive-force signal, and a total number of tablets sorted during the test operation.

7. A system comprising:

a tableting device, at least one of the individual sorting devices as claimed in claim 1, a plurality of compression punches, wherein the embossing element is configured to be removably attached to at least one of the compression punches and the at least one of the compression punches impresses a different punch image than the remaining compression punches.

8. A method for checking orderly functioning of an individual sorting device that sorts tablets which have been compressed by a tableting machine using compression punches, the individual sorting device comprising:

a tablet infeed, a compressive-force signal input for receiving compressive-force signals which are assignable to the infed tablets, a programmable controller unit, a memory, and a sorting unit, wherein the individual sorting device through the sorting unit is configured to separate (a) tablets, to which an impermissible compressive-force signal which is outside a permissible compressive-force range has been assigned, from (b) tablets, to which a compressive-force signal which is within the permissible compressive-force range has been assigned, wherein the memory stores a test control program configured to program the programmable controller unit for a test operation of the individual sorting device, wherein the test control program is configured, during the test operation, to impinge, incorporating an offset, compressive-force signals which can be assigned to the tablets which have been compressed by at least one of the compression punches of the tableting machine, the method comprising:

producing the tablets, using the tableting device;

feeding the tablets and compressive-force signals which are assignable to the tablets to the individual sorting device;

comparing the compressive-force signals with the permissible compressive-force range, and classifying the assigned tablets as permissible or impermissible, depending on the result of the comparison, wherein the compressive-force signals of selected compression punches prior to comparing are impinged, incorporating an offset, wherein at least one but not all compression punches are selected, and wherein an absolute value of the offset(s) is selected such that the impinged compressive-force signals are outside the permissible compressive-force range; and discarding impermissible tablets by means of the classification.

9. The method as claimed in claim 8, comprising furthermore:

determining a number of tablets produced by the selected compression punches;

determining a number of discarded tablets; and comparing the determined numbers.

10. The method as claimed in claim 8, wherein the selected compression punches are manipulated such that the tablets produced by means of the modified compression punches have an impressed image which is differentiable from an impressed image of the remaining produced tablets, comprising furthermore:

inspecting the impressed image of discarded tablets.

11. A method for carrying out a test operation of an individual sorting device that sorts tablets which have been compressed by a tableting machine using compression punches, the individual sorting device comprising:

a tablet infeed, a compressive-force signal input for receiving compressive-force signals which are assignable to the infed tablets, a programmable controller unit, a memory, and a sorting unit, wherein the individual sorting device through the sorting unit is configured to separate (a) tablets, to which an impermissible compressive-force signal which is outside a permissible compressive-force range has been assigned, from (b) tablets, to which a compressive-force signal which is within the permissible compressive-force range has been assigned, wherein the memory stores a test control program configured to program the programmable controller unit for the test operation of the individual sorting device, wherein the test control program is configured, during the test operation, to impinge, incorporating an offset, compressive-force signals which can be assigned to the tablets which have been compressed by at least one of the compression punches of the tableting machine, the method comprising: providing the memory in which a test control program configured to program a controller unit for the test operation of the individual sorting device is stored, wherein the test control program during the test operation comprises impinging, with an incorporated offset, compressive-force signals which can be assigned to tablets which have been compressed by at least one of the compression punches of the tableting machine.

12. The individual sorting device as claimed in claim 2, wherein the test control program is part of a normal operation program and the test operation precedes a normal operation.

13. The individual sorting device as claimed in claim 2, wherein the individual sorting device delivers the mutually separated tablets at two tablet deliveries and comprises at least one detection device which is disposed on one of the tablet deliveries and is suited to detecting tablets delivered thereby, wherein the detection device is connected to the controller unit and the controller unit is configured for counting a number of detected tablets.

14. The individual sorting device as claimed in claim 3, wherein the individual sorting device delivers the mutually separated tablets at two tablet deliveries and comprises at least one detection device which is disposed on one of the tablet deliveries and is suited to detecting tablets delivered thereby, wherein the detection device is connected to the controller unit and the controller unit is configured for counting a number of detected tablets.

15. The individual sorting device as claimed in claim 5, wherein the normal operation program suppresses the normal operation if a number of tablets counted during the test operation does not correspond to a nominal number.

16. The individual sorting device as claimed in claim 15, wherein the nominal number is determined by a number of the compression punches of the tableting machine, a number of the compression punches which are impinged with the offset compressive-force signal, and a total number of tablets sorted during the test operation.

17. The method as claimed in claim 9, wherein the selected compression punches are manipulated such that the tablets produced by means of the modified compression punches have an impressed image which is differentiable from an impressed image of the remaining produced tablets, comprising furthermore:

inspecting the impressed image of discarded tablets.

* * * * *